US012378854B2

(12) United States Patent
Bigelow et al.

(10) Patent No.: US 12,378,854 B2
(45) Date of Patent: Aug. 5, 2025

(54) SLIDING SLEEVE FOR GAS LIFT SYSTEM

(71) Applicant: Schlumberger Technology Corporation, Sugar Land, TX (US)

(72) Inventors: Jason Bigelow, St. John's (CA); Shivam Kumar Singh, Lawrence, KS (US); Arinta Fadly, Singapore (SG); Jason Michael Kamphaus, Missouri City, TX (US); Mark Anderson, Pearland, TX (US); Robert Krush, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/293,030

(22) PCT Filed: Jul. 29, 2022

(86) PCT No.: PCT/US2022/074298
§ 371 (c)(1),
(2) Date: Jan. 29, 2024

(87) PCT Pub. No.: WO2023/010108
PCT Pub. Date: Feb. 2, 2023

(65) Prior Publication Data

US 2024/0247572 A1 Jul. 25, 2024

(30) Foreign Application Priority Data

Jul. 29, 2021 (IN) ..... 202121034132

(51) Int. Cl.
*E21B 43/12* (2006.01)
*E21B 34/06* (2006.01)
*E21B 34/08* (2006.01)
*E21B 34/16* (2006.01)

(52) U.S. Cl.
CPC ..... *E21B 43/123* (2013.01); *E21B 34/066* (2013.01); *E21B 34/08* (2013.01); *E21B 34/16* (2013.01); *E21B 2200/06* (2020.05)

(58) Field of Classification Search
CPC ..... E21B 43/123; E21B 34/066; E21B 34/08; E21B 34/16; E21B 2200/06
See application file for complete search history.

(56) References Cited

U.S. PATENT DOCUMENTS

| | | | | |
|---|---|---|---|---|
| 5,263,683 | A | 11/1993 | Wong | |
| 5,305,833 | A | 4/1994 | Collins | |
| 6,763,892 | B2 | 7/2004 | Kaszuba | |
| 7,363,983 | B2 * | 4/2008 | Martinez | E21B 43/122 166/372 |
| 8,631,875 | B2 * | 1/2014 | Nguyen | E21B 43/123 166/372 |

(Continued)

FOREIGN PATENT DOCUMENTS

| | | | |
|---|---|---|---|
| CN | 103277078 | A | 9/2013 |
| WO | 2009114792 | A2 | 9/2009 |

OTHER PUBLICATIONS

International Search Report and Written Opinion issued in PCT Application PCT/US2022/074298, dated Nov. 8, 2022 (10 pages).

*Primary Examiner* — Aaron L Lembo
(74) *Attorney, Agent, or Firm* — Jeffrey D. Frantz

(57) ABSTRACT

A sliding sleeve design for downhole components is provided. The sliding sleeve can be used in gas lift systems.

20 Claims, 7 Drawing Sheets

(56) References Cited

U.S. PATENT DOCUMENTS

| | | | | |
|---|---|---|---|---|
| 10,890,057 | B2 * | 1/2021 | MacPhail | E21B 43/16 |
| 11,242,733 | B2 * | 2/2022 | Conrad | E21B 43/128 |
| 11,668,167 | B2 * | 6/2023 | Romer | E21B 43/122<br>137/155 |
| 11,680,461 | B2 * | 6/2023 | Partridge | E21B 17/1085<br>166/374 |
| 2004/0069491 | A1 | 4/2004 | Garay | |
| 2004/0262011 | A1 | 12/2004 | Huckabee | |
| 2005/0230121 | A1 | 10/2005 | Martinez | |
| 2008/0217021 | A1 * | 9/2008 | Lembcke | E21B 34/063<br>166/334.4 |
| 2012/0055684 | A1 * | 3/2012 | Zimmerman | E21B 43/14<br>166/318 |
| 2013/0140040 | A1 * | 6/2013 | George | E21B 34/06<br>166/386 |
| 2014/0116719 | A1 * | 5/2014 | Balasubramanian | E21B 43/123<br>166/372 |
| 2015/0083433 | A1 * | 3/2015 | Long | E21B 33/10<br>166/372 |
| 2016/0010429 | A1 * | 1/2016 | Getzlaf | E21B 43/25<br>166/373 |
| 2019/0178064 | A1 | 6/2019 | Velde | |
| 2019/0368311 | A1 * | 12/2019 | Krawiec | E21B 43/127 |
| 2021/0140287 | A1 * | 5/2021 | Lisk | E21B 43/123 |

* cited by examiner

SLIDING SLEEVE FOR GAS LIFT SYSTEM

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is a national stage entry under 35 U.S.C. 371 of International Application No. PCT/US2022/074298, filed Jul. 29, 2022, which claims priority benefit of Indian Provisional Application No. 202121034132, filed Jul. 29, 2021, the entirety of which is incorporated by reference herein and should be considered part of this specification.

BACKGROUND

Field

The present disclosure generally relates to gas lift, and more particularly to a sliding sleeve design for use in a gas lift system.

Description of the Related Art

Oil and gas wells utilize a borehole drilled into the earth and subsequently completed with equipment to facilitate production of desired fluids from a reservoir. Subterranean fluids, such as oil, gas, and water, are produced from the wellbore. In some cases, the fluid is produced to the surface naturally by downhole formation pressures. However, the fluid must often be artificially lifted from wellbores by the introduction of downhole equipment. Various types of artificial lift are available. In a gas lift system, a compressor is located on the surface. The compressor pumps gas down the casing tubing annulus. The gas is then released into the production tubing via gas valves that are strategically placed throughout the production tubing. The gas that is introduced lightens the hydrostatic weight of the fluid in the production tubing, allowing the reservoir pressure to lift the fluid to surface.

SUMMARY

In some configurations, a sliding sleeve assembly for a downhole component includes one or more tubing segments; a sleeve slidably disposed within one or more of the tubing segments; a body disposed along the one or more tubing segments, the body comprising at least one port extending through the body; and at least one plug, the at least one plug configured to cooperate with the at least one port to choke fluid flow through the port.

The at least one port can include two ports spaced 180° apart from each other about a circumference of the body. The sleeve can include a plurality of apertures. When the sleeve is in an open position, an annulus outside of the tubing segments is placed in fluid communication with an inside of the tubing segments via a fluid path through the plug and through the plurality of apertures. When the sleeve is in a closed position, the fluid path is blocked. The sleeve can be operated mechanically, hydraulically, electrically, or electro-mechanically.

In some configurations, a sliding sleeve assembly for a downhole component includes one or more tubing segments; a sleeve slidably disposed within one or more of the tubing segments; and a body disposed along the one or more tubing segments, the body comprising at least one port extending through the body.

The sleeve can include a plurality of apertures. When the sleeve is in an open position, fluid can flow through the port and through the plurality of apertures into the tubing segments. When the sleeve is in a closed position, fluid is blocked from flowing from the tubing through the plurality of apertures to the port. The sleeve can be mechanically, hydraulically, electrically, or electro-mechanically operated. The sleeve can be controlled from the surface or sub-surface controlled.

The body can be eccentric. A gas lift valve can be operably coupled to the port of the body in use, such that fluid can flow through the gas lift valve and through the port. The assembly can further include a guard configured to protect the gas lift valve. The guard can include a channel through which the gas lift valve extends. The guard can be integral with or separate from and coupled to one of the tubing segments.

The sliding sleeve assembly can be included in a gas lift system or operation.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
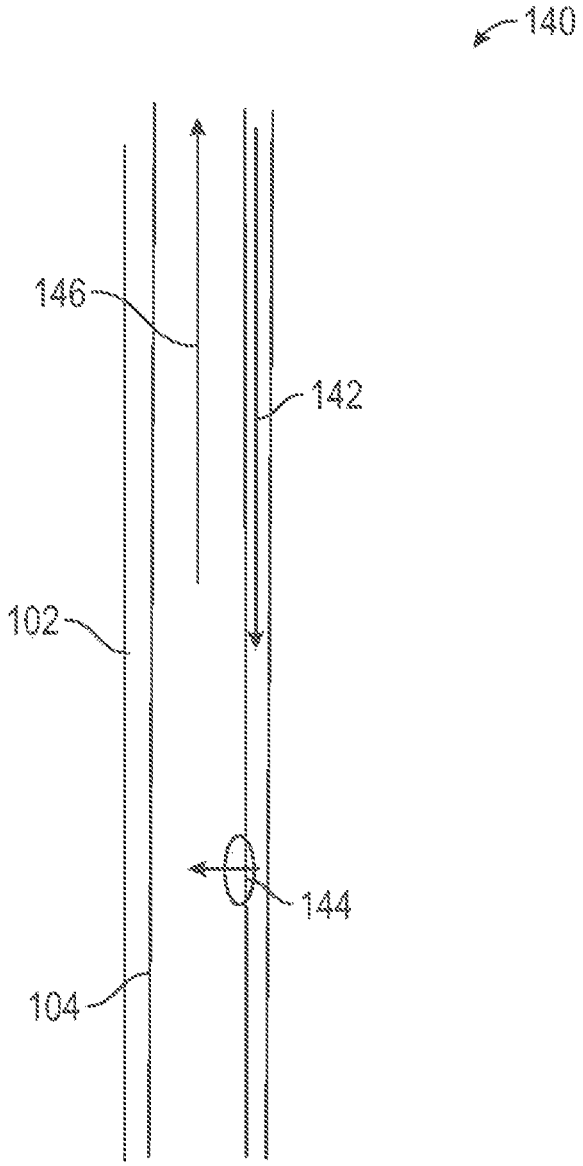
FIG. 1 schematically illustrates a portion of an example gas lift system.

FIG. 1 illustrates a downhole portion of an example gas lift system 140. The gas lift system 140 includes a compressor located at the well surface. In use, the compressor pumps gas down the annulus between the casing 102 and the tubing 104, as indicated by arrow 142. The gas is then released into the tubing 104 via one or more gas valves 144 that are strategically placed throughout the tubing 104. The gas lessens the hydrostatic weight of the fluid in the tubing 104, allowing the reservoir pressure to lift the fluid to the surface, as indicated by arrow 146.

The present disclosure provides various sliding sleeve designs for downhole tools. Sliding sleeves according to the present disclosure can be used in gas lift systems. However, the sliding sleeves can be used in other applications. In various configurations, the sliding sleeves can be controlled mechanically, hydraulically, electrically, or electro-mechanically. The sliding sleeves can be controlled from the surface or sub-surface controlled.

In some gas lift applications, reservoir stimulations, such as hydraulic fracturing and/or matrix acidizing, are performing through the tubing during the lifetime of the well. During reservoir stimulation treatment, high pressure, high rate fluids with proppant or acid are pumped into the tubing. This may damage chokes, check valves, and/or other components of the gas lift equipment. Various sliding sleeve designs according to the present disclosure can advantageously help protect gas lift equipment, such as choke(s) or check valve(s), for example, during stimulation.

Figure 2:
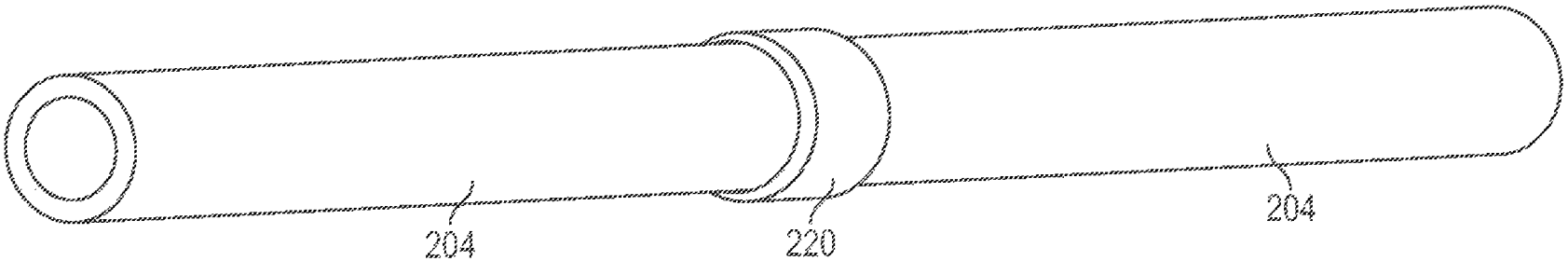
FIG. 2 shows a perspective view of an example sliding sleeve design.
Figure 3:
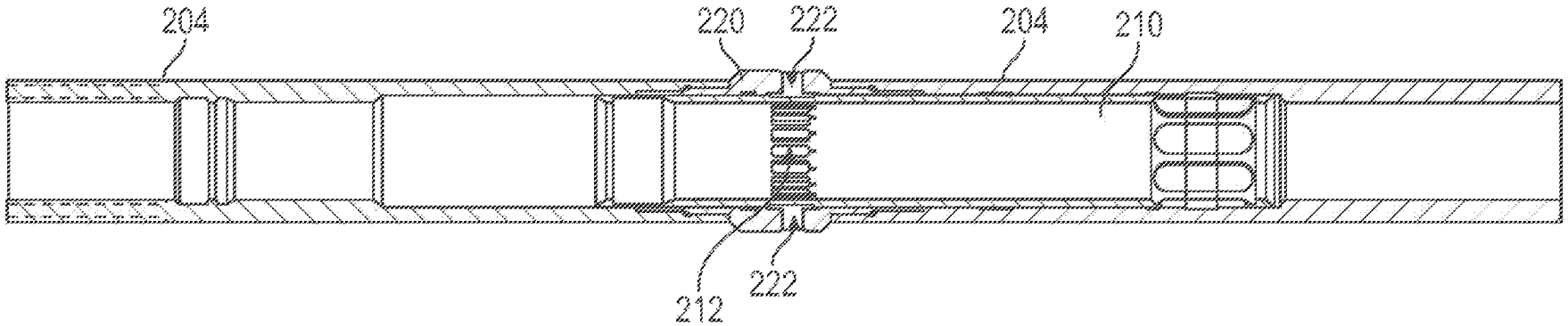
FIG. 3 shows a longitudinal cross-section of the sliding sleeve design of FIG. 2.
Figure 4:
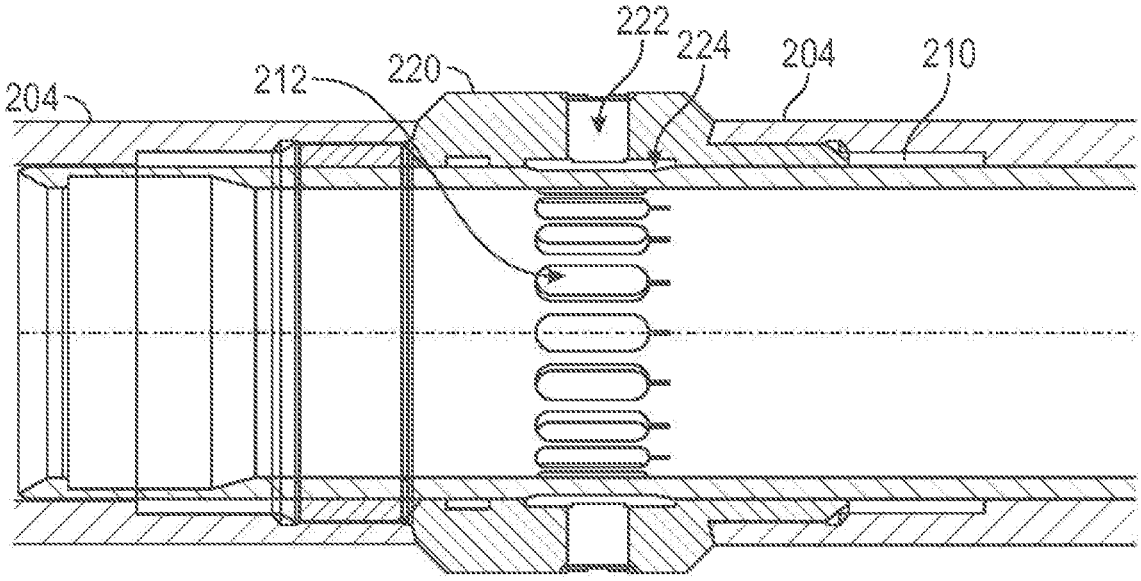
FIG. 4 shows a partial longitudinal cross-section of the sliding sleeve design of FIG. 2.
Figure 5:
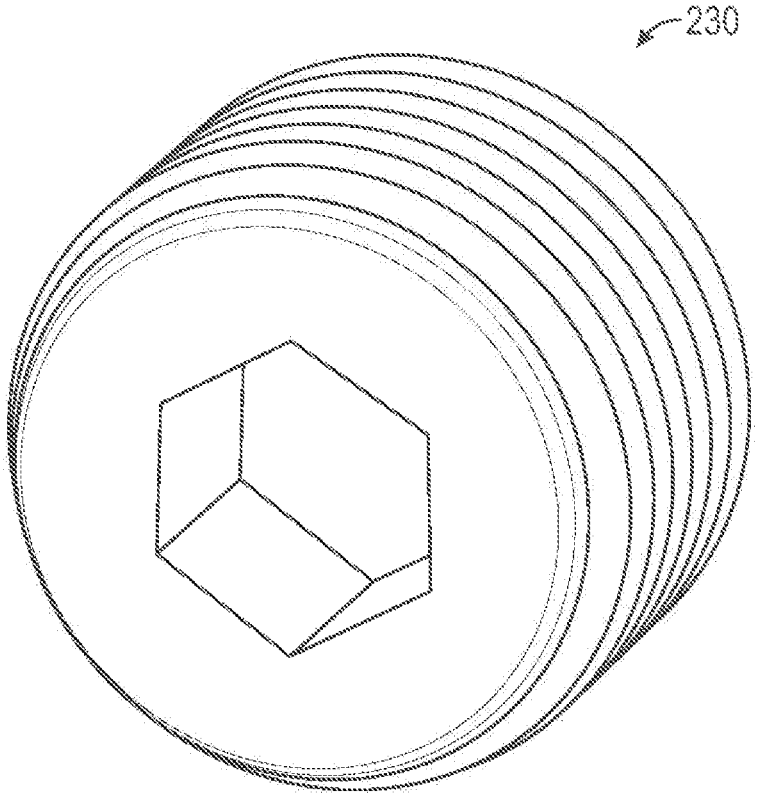
FIG. 5 shows a perspective view of a plug that can be included in the sliding sleeve design of FIG. 2.

An example of a sliding sleeve assembly design according to the present disclosure is shown in FIGS. 2-4. The illustrated design includes a sliding sleeve and a ported body. As shown, the assembly can include one or more segments of tubing or housing 204, a body 220 disposed along the tubing or housing 204, and a sleeve 210 slidably disposed relative to the housing 204 and body 220. In the configuration of FIGS. 2-4, the sleeve 210 is slidably disposed within the housing 204. The illustrated body 220 includes two ports 222 located or spaced 180° from each other around a circumference of the body 220. However, more or fewer ports 222 are possible, and the ports 222 can be located at different angular positions or spacings. For example, the body 220 could include three ports 222 located or spaced 120° from each other about the circumference of the body 220. The ports 222 can include threads, e.g., ½" NPT threads, tapped in or on them. A ported plug 230, for example as shown in FIG. 5, is disposed in and/or cooperates with each of the ports 222. The embodiment of FIGS. 2-4 advantageously has a slim outer diameter, which can allow the design to fit and be used in small casing sizes The ports 222 provide a flow path or fluid communication between an annulus or area radially or circumferentially outside of the assembly and an annulus or area 224 radially between a portion of the body 220 and sliding sleeve 210. As shown, the sliding sleeve 210 can include a plurality of apertures 212, such that fluid can flow through the sliding sleeve 210 depending on the position of the sliding sleeve 210, for example, relative to the port(s) 222 and/or area 224. When gas lifting is required in use, gas can be injected through the ported plugs 230, which can act as a choke. The plug 230 can include a through hole of a desired size or an internal nozzle to allow a desired amount of fluid flow through the plug 230. In some configurations, the plug 230 can include a check valve or check mechanism such that fluid flow is only allowed in one direction, for example, from the outer annulus into the tubing, and fluid flow from the tubing to the annulus is blocked.

If the sliding sleeve 210 is positioned relative to the body 220 such that the apertures 212 are at least partially radially aligned with the area 224, the sleeve 210 can be considered in an "open" position, and gas can flow through the ported plugs 230, into the annular space 224 between the body 220 and sliding sleeve 210, and then through the apertures 212 into an interior of the sleeve 210. If the sleeve 210 is positioned relative to the body 220 such that the apertures 212 are not radially aligned with the area 224 (e.g., there is no overlap of the apertures 212 with the area 224), the sleeve 210 can be considered in a "closed" position. In the closed position, gas cannot flow from the annular space 224 between the body 220 and the sleeve 210 into the interior of the sleeve 210, and fluid in the interior of the sleeve 210 cannot flow into the space 224 or through the ports 222.

The sleeve 210 can be opened during injection of gas for gas lift to allow the gas to pass from the annulus into the tubing, and closed during injection of chemicals in the tubing, which could otherwise damage the gas lift valve. The sleeve 210 can be shifted relative to the body 220 mechanically, hydraulically, or electrically, and can be surface or sub-surface controlled. In some configurations, the sleeve 210 may move between full open and full closed positions. In other configurations, the sleeve 210 may move among a plurality of positions between and inclusive of full open and full closed by increasing or decreasing the area of the apertures 212 in fluid communication with the area 224 to increase or decrease flow through the apertures 212. In some such configurations, the sleeve 210 can be flow or choke activated or controlled, such that, for example, as production flow decreases, the sleeve 210 is moved toward the open position to increase the area of the apertures 212 in fluid communication with the area 224 to increase flow through the apertures 212 and therefore increase the artificial lift.

Figure 6:
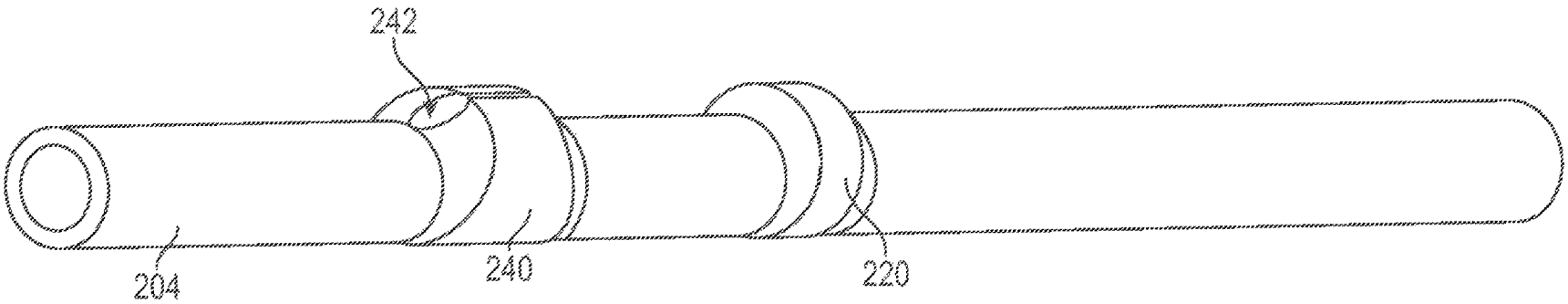
FIG. 6 shows a perspective view of another example sliding sleeve design.
Figure 7:
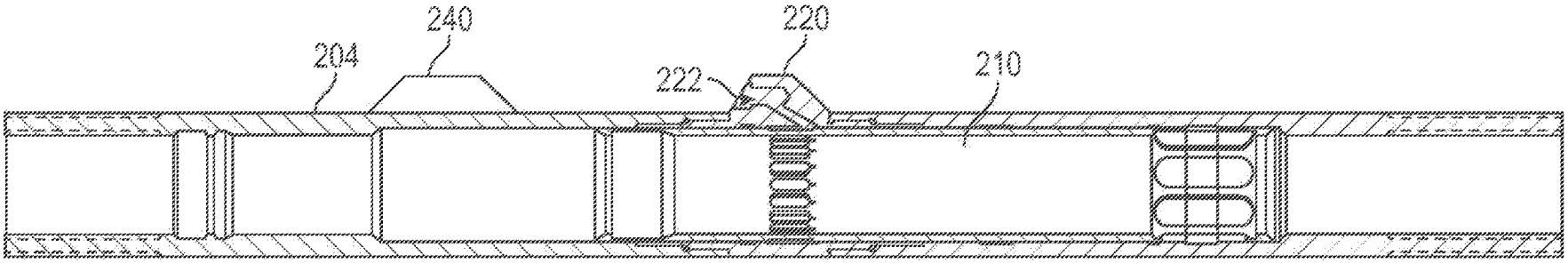
FIG. 7 shows a longitudinal cross-section of the sliding sleeve design of FIG. 6.
Figure 8:
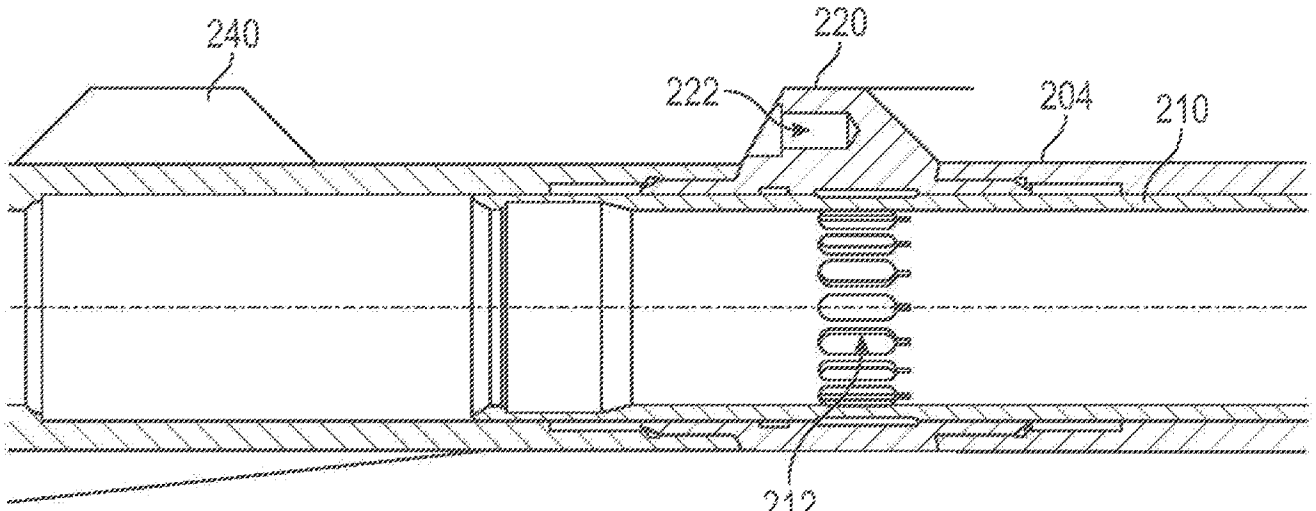
FIG. 8 shows a partial longitudinal cross-section of the sliding sleeve design of FIG. 6.
Figure 9:
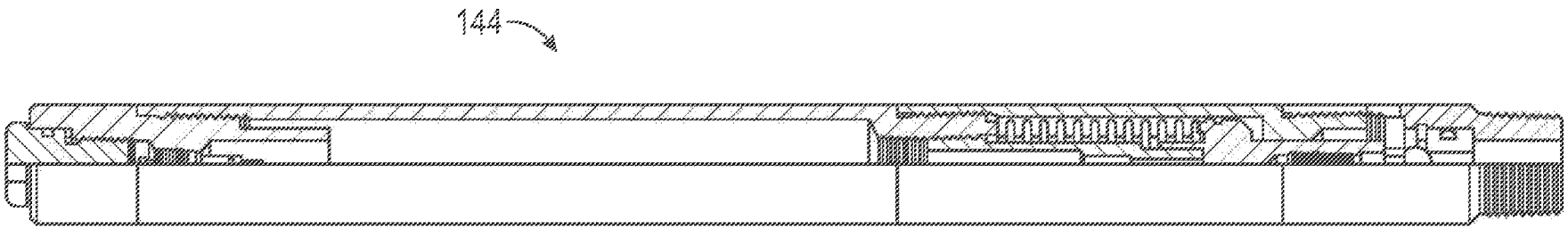
FIG. 9 illustrates a conventional gas lift valve.

FIGS. 6-8 illustrate another example sliding sleeve design according to the present disclosure. The embodiment of FIGS. 6-8 includes a sliding sleeve 210, an eccentric ported body 220, and a guard 240. A conventional tubing-retrievable gas lift valve 144, for example, as shown in FIG. 9, can be installed at least partially in, on, or adjacent to the eccentric ported body 220. In use, fluids (e.g., gas) can flow through the gas lift valve 144 and into and through the port 222 in the body 220 to reach the interior of the body 220 and tubing or housing 204. The guard(s) 240 (e.g., guard fins in the illustrated configuration) is (are) disposed on and/or protrudes radially outwardly from an outside diameter of the tubing 204. The guard(s) 240 can be integral with or coupled to (e.g., a clamp-type guard) the tubing 204. The guard(s) 240 advantageously help protect the gas lift valve 144 when the gas lift valve 144 is installed in, on, or adjacent the eccentric ported body 220. In some configurations, the guard 240 includes a channel 242 through which the gas lift valve 144 can extend. The embodiment of FIGS. 6-8 advantageously uses a gas lift valve 144 to regulate gas lift injection, and the valve 144 can advantageously include a backcheck, which can help ensure tubing pressure integrity.

The sleeve 210 can be shifted relative to the body 220 mechanically, hydraulically, or electrically, and can be surface or sub-surface controlled. In some configurations, the sleeve 210 may move between full open and full closed positions. In other configurations, the sleeve 210 may move among a plurality of positions between and inclusive of full open and full closed by increasing or decreasing the area of the apertures 212 in fluid communication with the area 224 to increase or decrease flow through the apertures 212. In some such configurations, the sleeve 210 can be flow or choke activated or controlled, such that, for example, as production flow decreases, the sleeve 210 is moved toward the open position to increase the area of the apertures 212 in fluid communication with the area 224 to increase flow through the apertures 212 and therefore increase the artificial lift.

Figure 10:
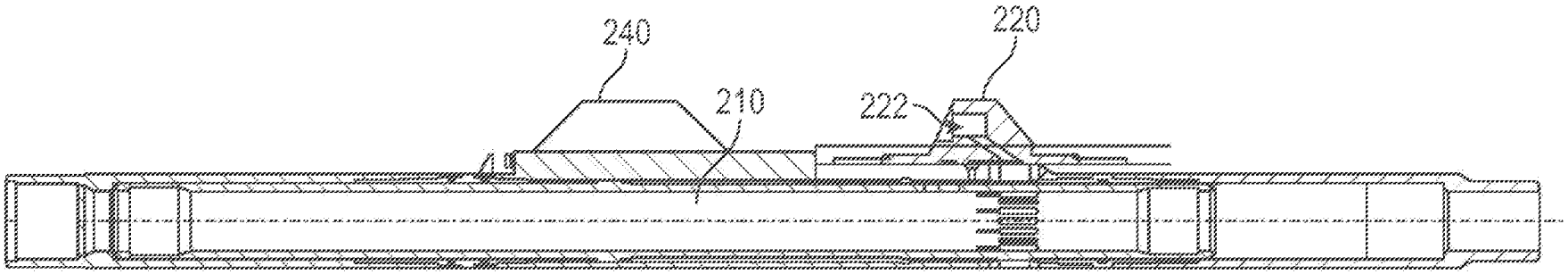
FIG. 10 shows a perspective view of another example sliding sleeve design.

Another example sliding sleeve design according to the present disclosure is shown in FIG. 10. This embodiment includes a surface-controlled, hydraulically-operated sliding sleeve 210, an eccentric ported body 220, and a guard 240. A tubing-retrievable gas lift valve 144, for example as shown in FIG. 9, can be coupled to the ported body 220 for gas lift operation. In use, fluids (e.g., gas) can flow through the gas lift valve 144 and into and through the port(s) 222 in the body 220 to reach the interior of the body 220 and tubing or housing 204. The guard 240 advantageously protects the gas lift valve 144 during run-in-hole. The embodiment of FIG. 10 advantageously does not require through-tubing intervention to shift the sliding sleeve 210. The gas lift valve 144 regulates gas lift injection, and the valve can advantageously include a backcheck, which can help ensure tubing pressure integrity.

Figure 11:
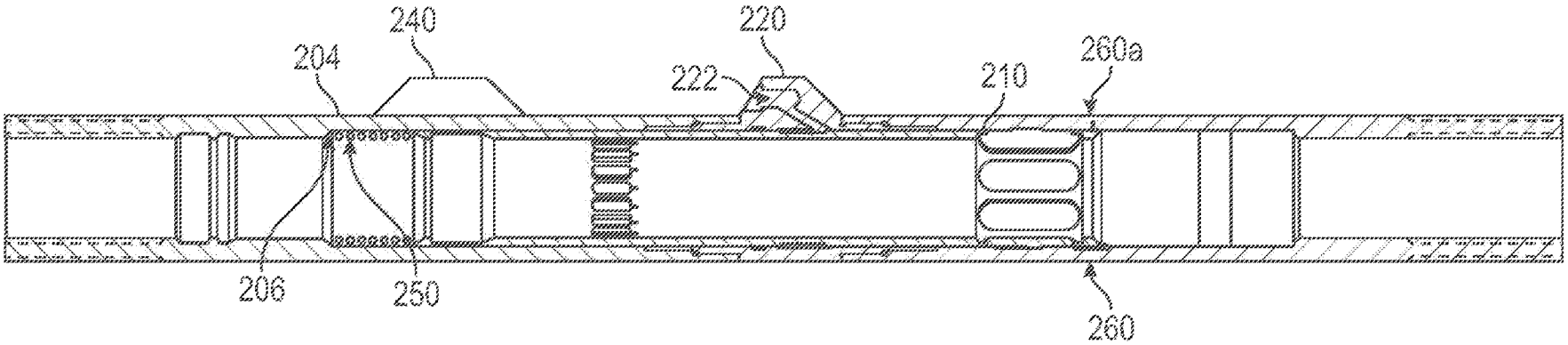
FIG. 11 shows a longitudinal cross-section of another example sliding sleeve design.

FIG. 11 illustrates a sliding sleeve design in which movement of the sleeve is caused by a spring. As shown, the assembly includes a ported body 220, a sliding sleeve 210, a spring 250, and a holding mechanism 260. In the illustrated configuration, the spring 250 is positioned within the tubing 204 axially between an upper or uphole end of the sleeve 210 and an interior shoulder 206 of the tubing 204. Instead of a spring 250, the assembly can include another biasing or energized device, for example, a gas chamber. The holding mechanism 260 can be, for example, a latch, collet, magnet, or one or more shear screws **260*a*. The holding mechanism 260 can be positioned at or near a bottom or downhole end of the sleeve 210** as shown.

In the illustrated configuration, the sleeve 210 is initially held in the closed position by the holding mechanism 260, and the spring 250 is compressed (or other device is energized). In use, for example, when gas injection for gas lift is desired, the holding mechanism 260 is released. The holding mechanism 260 can be released by various mechanisms, for example, a latch being electronically activated or overcome, mechanical shearing, or flow overcoming shear screws. With the holding mechanism 260 released, the spring 250 expands or the energized device acts to slide the sleeve 210 to the open position. Therefore, in the configuration of FIG. 11, rather than a signal or input sliding the sleeve 210, a signal or input releases the holding mechanism, and the sleeve 210 is moved by energy stored in a component of the assembly (i.e., the spring or other energized device).

In some configurations, a sliding sleeve according to the present disclosure can be adapted for use with a retrievable gas lift valve disposed in a side pocket mandrel. For example, a retrievable (e.g., by wireline or slickline) gas lift valve can be disposed in the side pocket of a side pocket mandrel, and the sliding sleeve 210 can be disposed in the main bore of the mandrel. Alternatively, the sliding sleeve 210 could be disposed in the side pocket, and the retrievable gas lift valve could be disposed within the sliding sleeve 210. The sliding sleeve 210 could be actuated to block fluid communication between the side pocket and main bore of the mandrel during injection of chemicals or other fluids in the tubing.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A sliding sleeve assembly for a gas lift system, the sliding sleeve assembly comprising:

one or more tubing segments;

a sleeve slidably disposed within one or more of the tubing segments;

a body disposed along the one or more tubing segments, the body comprising at least one port extending through the body from an exterior of the one or more tubing segments to an interior of the one or more tubing segments, wherein the sleeve is movable between a first position in which the sleeve obscures the at least one port, and a second position in which the sleeve uncovers the at least one port; and at least one plug, the at least one plug configured to be disposed within the at least one port to choke fluid flow through a through hole of the plug in the at least one port.

2. The sliding sleeve assembly of claim 1, wherein the at least one port comprises two ports spaced 180° apart from each other about a circumference of the body; wherein each port has a plug disposed within the port.

3. The sliding sleeve assembly of claim 1, the sleeve comprising a plurality of apertures, wherein when the sleeve is in the second position, an annulus outside of the tubing segments is placed in fluid communication with an inside of the tubing segments via a fluid path through the plug and through the plurality of apertures, and when the sleeve is in the first position, the fluid path is blocked.

4. The sliding sleeve assembly of claim 1, wherein the sleeve is operated mechanically, hydraulically, electrically, or electro-mechanically.

5. The sliding sleeve assembly of claim 1, wherein the body is coupled between adjacent tubing segments of the one or more tubing segments.

6. A sliding sleeve assembly for a gas lift system, the sliding sleeve assembly comprising:

one or more tubing segments;

a sleeve slidably disposed within one or more of the tubing segments; and a body disposed along the one or more tubing segments, the body comprising at least one port extending through the body from an exterior of the one or more tubing segments to an interior of the one or more tubing segments, wherein the sleeve is movable between a first position in which the sleeve obscures the at least one port, and a second position in which the sleeve uncovers the at least one port; and a gas lift valve is operably coupled to the at least one port of the body in use, such that fluid can flow through the gas lift valve and through the at least one port.

7. The sliding sleeve assembly of claim 6, the sleeve comprising a plurality of apertures.

8. The sliding sleeve assembly of claim 7, wherein when the sleeve is in the second position, fluid can flow through the at least one port and through the plurality of apertures into the tubing segments.

9. The sliding sleeve assembly of claim 7, wherein when the sleeve is in the first position, fluid is blocked from flowing from the tubing segments through the plurality of apertures to the at least one port.

10. The sliding sleeve assembly of claim 6, wherein the body is eccentric.

11. The sliding sleeve assembly of claim 6, further comprising a guard configured to protect the gas lift valve.

12. The sliding sleeve assembly of claim 11, the guard comprising a channel through which the gas lift valve extends.

13. The sliding sleeve assembly of claim 11, wherein the guard is integral with one of the one or more tubing segments.

14. The sliding sleeve assembly of claim 11, wherein the guard is separate from and coupled to one of the one or more tubing segments.

15. The sliding sleeve assembly of claim 6, wherein the sleeve is mechanically operated.

16. The sliding sleeve assembly of claim 6, wherein the sleeve is hydraulically operated.

17. The sliding sleeve assembly of claim 6, wherein the sleeve is electrically operated.

18. The sliding sleeve assembly of claim 6, wherein the sleeve is surface controlled.

19. The sliding sleeve assembly of claim 6, wherein the sleeve is sub-surface controlled.

20. The sliding sleeve assembly of claim 6, wherein the body is coupled between adjacent tubing segments of the one or more tubing segments.

* * * * *